US008360743B2

(12) United States Patent
Walters

(10) Patent No.: US 8,360,743 B2
(45) Date of Patent: Jan. 29, 2013

(54) ROTARY PRESSURE PRODUCTION DEVICE

(75) Inventor: Randall W. Walters, Rice Lake, WI (US)

(73) Assignee: Randy Walters, Rice Lake, WI (US)

( * ) Notice: Subject to any disclaimer, the term of this patent is extended or adjusted under 35 U.S.C. 154(b) by 349 days.

(21) Appl. No.: 12/692,124

(22) Filed: Jan. 22, 2010

(65) Prior Publication Data

US 2010/0189573 A1 Jul. 29, 2010

Related U.S. Application Data

(60) Provisional application No. 61/205,621, filed on Jan. 23, 2009.

(51) Int. Cl.
*F04B 27/10* (2006.01)
*F04B 35/01* (2006.01)
*H02K 7/18* (2006.01)

(52) U.S. Cl. ..... 417/273; 417/540; 417/545; 417/547; 138/30

(58) Field of Classification Search ..... 417/273, 417/470, 540, 545, 547; 138/30
See application file for complete search history.

(56) References Cited

U.S. PATENT DOCUMENTS 2,773,455 A * 12/1956 Mercier ..... 417/540
3,587,653 A * 6/1971 Alphonse et al. ..... 138/30
5,167,493 A * 12/1992 Kobari ..... 417/273
5,255,641 A 10/1993 Schechter
5,438,829 A * 8/1995 Kubota et al. ..... 60/410
5,511,956 A * 4/1996 Hasegawa et al. ..... 417/271
6,065,945 A 5/2000 Zamzow
6,244,257 B1 6/2001 Hu
6,293,231 B1 9/2001 Valentin
6,406,271 B1 6/2002 Valentin
6,446,435 B1 * 9/2002 Willmann et al. ..... 60/533
6,470,786 B2 10/2002 Uski
6,484,674 B2 11/2002 Valentin
6,551,076 B2 4/2003 Boulware
6,736,099 B2 5/2004 Mori et al.
6,769,405 B2 8/2004 Leman et al.
6,854,958 B2 2/2005 Desy
6,926,494 B2 8/2005 Sabourin
6,942,591 B2 9/2005 Park
7,080,521 B2 7/2006 Ludwig et al.
7,194,990 B2 3/2007 Sun
7,195,460 B2 3/2007 Bazin et al.
7,241,242 B2 7/2007 Schmidt
7,314,026 B2 1/2008 Koneda et al.
7,316,212 B2 1/2008 Tagami et al.
7,481,053 B2 1/2009 Kitano et al.
2003/0116895 A1 * 6/2003 Luncz ..... 267/64.11
2007/0071622 A1 * 3/2007 Schoeppe ..... 417/470
2007/0110590 A1 * 5/2007 Pabst et al. ..... 417/273
2008/0298982 A1 * 12/2008 Pabst et al. ..... 417/273
2009/0095366 A1 * 4/2009 Gray, Jr. ..... 138/30

* cited by examiner

*Primary Examiner* — Devon Kramer
*Assistant Examiner* — Dominick L Plakkoottam
(74) *Attorney, Agent, or Firm* — Merchant & Gould P.C.

(57) ABSTRACT

A rotary pressure production turbine for pressurizing a hydraulic fluid is disclosed comprising a plurality of piston assemblies. Each piston assembly comprises a hollow needle piston shaft having through which hydraulic fluid is moved from a low pressure volume to a high pressure volume as the piston shaft moves in a first direction. A rotary actuator actuates each piston shaft. From the high pressure volume, hydraulic fluid is moved to a common high pressure header and delivered to an aspirated accumulator where the fluid can be stored and subsequently utilized. In some embodiments, the fluid is utilized to operate an electric generator for use in a hybrid-electric vehicle. In some embodiments, the rotary actuator is driven by an internal combustion engine, while in others the rotary actuator is driven by a vehicle drive train in a regenerative braking application.

19 Claims, 13 Drawing Sheets

ROTARY PRESSURE PRODUCTION DEVICE

CROSS REFERENCE TO RELATED APPLICATIONS

This application claims priority under 35 U.S.C. §119(e) to U.S. Provisional Application 61/205,621, filed Jan. 23, 2009. The complete disclosure of U.S. Provisional Application 61/205,621 is hereby incorporated in its entirety.

BACKGROUND

This application relates to hydraulic pressure production devices and systems in which they can be utilized. Methods for the production of pressurized hydraulic fluid are also disclosed.

SUMMARY

A pressure production system for pressurizing a hydraulic fluid that utilizes a rotary pressure production device is disclosed. The device system includes a plurality of piston assemblies, each of which has a hollow needle piston shaft through which hydraulic fluid is moved from a low pressure volume into a high pressure volume as the piston shaft moves in a first direction. The piston assemblies discharge fluid into a common high pressure header from the high pressure volume, and further include a vacuum check valve in fluid communication with the low and high pressure volumes. In operation, the vacuum check valve is closed as the hollow piston shaft moves in the first direction and open as the hollow piston shaft moves in a second, opposite direction. A discharge check valve can also be provided that is in fluid communication with the first high pressure volume and the high pressure header, the discharge check valve being open when hollow piston shaft is moving in the first direction and closed when shaft is moving in the second direction. The device system also includes a rotary piston actuator that moves each hollow piston shaft in the first direction when the rotary piston actuator is rotating.

The rotary pressure production device system can be used in a larger system, such as in a hybrid over electric vehicle. In such an application, the device system can be driven by an internal combustion engine and the second high pressure fluid volume can take the form of a header assembly combined with a fluid storage aspirated accumulator where the pressurized hydraulic fluid can be stored until needed. In such an application, the accumulator can be pre-pressurized by a gas behind a diaphragm wall such that the stored hydraulic fluid is maintained at a minimum operating pressure. Pressurized hydraulic fluid from the accumulator can be used to power a hydraulic motor coupled to an electric generator to provide electric power to the vehicle. Additionally, the pressurized hydraulic fluid can also be used to power a hydraulic motor coupled to a gas compressor, such as an air compressor for pre-pressurizing the accumulator. A number of check valves can also be provided within the accumulator to prevent rupturing of the diaphragm wall.

Additionally disclosed is a method for pressurizing hydraulic fluid, the method comprising the steps of (a) drawing hydraulic fluid from a low pressure volume into a hollow needle piston shaft; (b) moving the hollow needle piston shaft and the hydraulic fluid within the hollow needle piston shaft in a first direction and into a high pressure volume; (c) closing fluid communication between the high pressure volume and the low pressure volume; (d) compressing the hydraulic fluid in the high pressure volume with the hydraulic fluid in the hollow needle piston such that the fluid is moved into a common high pressure header, the header being in fluid communication with the high pressure volume; (e) moving the hollow needle piston shaft in a second direction opposite the first direction; (f) closing fluid communication between the high pressure volume and the high pressure header. The method can also be performed such that the steps are repeated continuously and with a plurality of hollow needle piston shafts in either a synchronized manner, or at different times.

DETAILED DESCRIPTION

Figure 1:
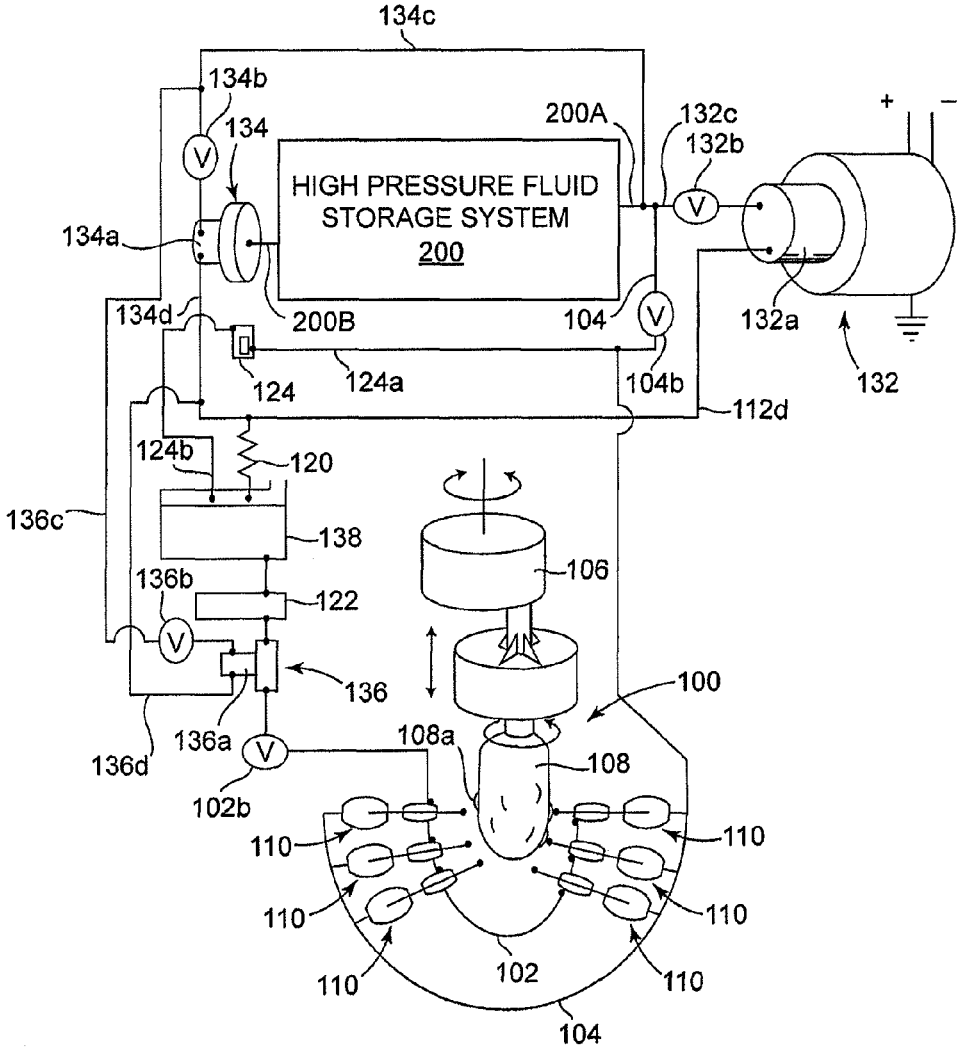
FIG. 1 is a schematic of a first embodiment of a system for producing, storing and utilizing pressurized hydraulic fluid, the system including a rotary pressure production device and a high pressure fluid storage system.

This disclosure relates to systems for the production of pressurized hydraulic fluid. FIG. 1 represents a system in which pressurized hydraulic fluid is produced, stored and utilized. As shown, pressurized hydraulic fluid is produced by a rotary pressure production device 100 that can be delivered to one or more end use devices. Examples of end use devices are linear actuators (i.e. hydraulic cylinders), rotary actuators, brakes, hydrostatic transmissions and hydraulic motors. Hydraulic motors are particularly useful for a variety of purposes similar to those applicable for electric motors and internal combustion engines. For example, hydraulic motors can be used to drive electric generators, gas compressors, fluid pumps, vehicle drive trains, or for any application where rotary power is desired.

In the embodiment shown in FIG. 1, a rotary pressure production device 100 is disclosed. Rotary pressure production device 100 is for producing high pressure hydraulic fluid from a low pressure fluid source. By use of the term "high pressure" it is generally meant to include pressures above 100 pounds per square inch (psi), and more preferably pressures above 1,000 psi. By the use of the term "low pressure" it is generally meant to include all pressures at or below 100 psi, including negative pressures. Many variations of a rotary pressure production device 100 exist without departing from the concepts disclosed herein. In the particular embodiment shown in FIG. 1, rotary pressure production device 100 includes a plurality of piston assemblies 110 that, when actuated, move hydraulic fluid from a common low pressure header 102 to a common high pressure header 104. As shown, the piston assemblies 110 are actuated by a drive source 106 having a rotary actuator 108 that engages the piston assemblies 110 via cam lobes 108*a*. Drive source 106 can be an internal combustion engine, the drive train of a vehicle, or any other rotating power source. In the exemplary embodiment shown, drive source 106 is an internal combustion engine and rotary actuator 108 is configured to eccentrically rotate such that the piston assemblies 110 are actuated out of phase. By actuating piston assemblies 110 out of phase with each other, a more even production of pressurized hydraulic fluid can be accomplished.

As shown in FIG. 1, high pressure hydraulic fluid is delivered to several end use devices including electric generator 132, gas compressor 134, hydraulic fluid pump 136 and high pressure fluid storage system 200. Electric generator 132 can be used to supply electrical power for a variety of applications, including an electric motor in a hybrid-electric vehicle. Gas compressor 134 is for aspirating the high pressure fluid storage system 200 with a gas, such as compressed air. Hydraulic fluid pump 136 is for delivering low pressure hydraulic fluid to the common low pressure header 102 from the low pressure fluid reservoir 138 where hydraulic fluid is returned after being exhausted by the end use devices. Pump 136 can deliver a variety of pressures. However, a range of 10 pounds per square inch (psi) to 100 psi is the most likely delivery pressure for the disclosed application. High pressure fluid storage system 200, discussed later, is for storing high pressure hydraulic fluid until it is needed by the end use devices.

As shown, generator 132, compressor 134 and pump 136 are each driven by a hydraulic motor 132*a*, 134*a*, 136*a*. Each of the motors 132*a*, 134*a*, 136*a* is supplied with high pressure hydraulic fluid from high pressure header 104 via lines 132*c*, 134*c* and 136*c*, respectively. The power output for each of the motors 132*a*, 134*a*, 136*a* is selectively controlled by a corresponding actuated valve 132*b*, 134*b*, 136*b*. Once the hydraulic fluid is used and exhausted from the hydraulic motors 132*a*, 134*a*, 136*a*, the fluid is returned via lines 132*d*, 134*d*, 136*d* to a low pressure reservoir 138 where the fluid can be processed and provided back to the device 110. One example of processing that can be performed on the fluid is the use of an oxygen scrubber and contaminant removal filter 122 disposed between the reservoir 138 and the device 110. The oxygen scrubber is particularly useful where large size differentials exist between housing 117 (discussed later) and shaft 111 (discussed later) as the fluid should be maintained as incompressible as possible. The exhausted fluid can also be cooled by a heat exchanger 120 prior to being returned to the reservoir 138. Additionally, in the event that none of the end use devices 132, 134, 136, 200 can accept additional high pressure hydraulic fluid at a point in time where the device 110 is still producing high pressure hydraulic fluid, the fluid can be passed through a pressure reducing valve (PRV) 124 and returned to the reservoir 138 via lines 124*a*, 124*b*. Valve 104*b* can also shut to aid in directing fluid to the PRV 124. However, it should be understood that the device 110 is optimally controlled to minimize the need for use of the pressure reduction valve 122, such as by modulating the rotating speed of the drive source 106.

Figure 2:
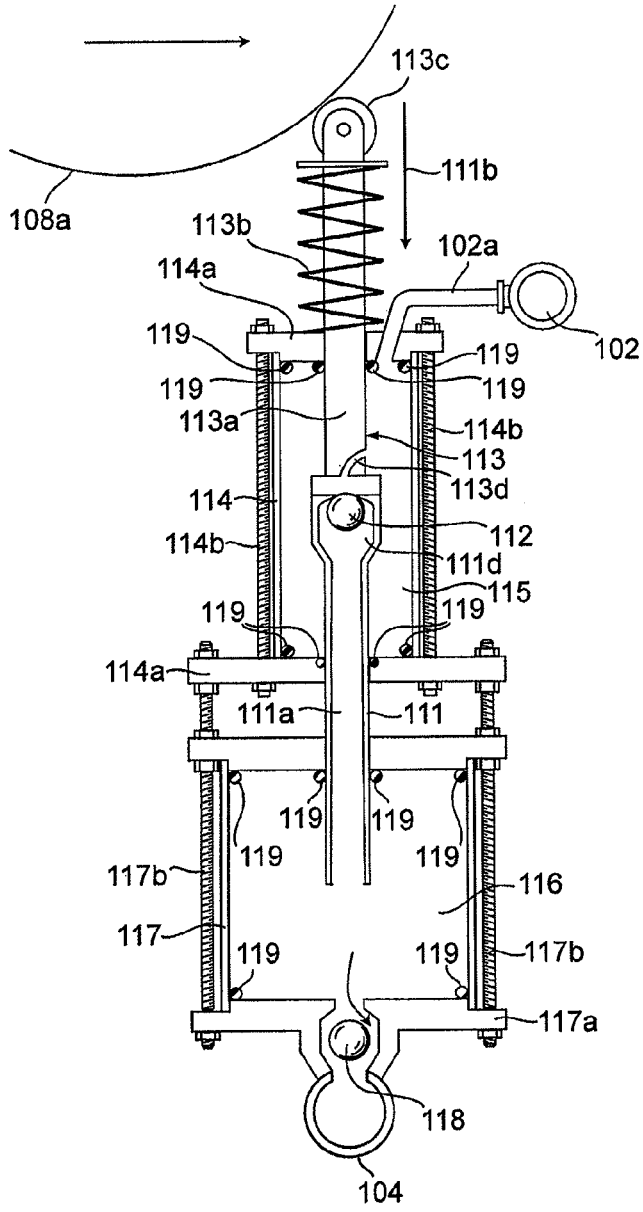
FIG. 2 is a schematic of a first embodiment of a piston assembly in a first state for use in the rotary pressure production device of FIG. 1.
Figure 3:
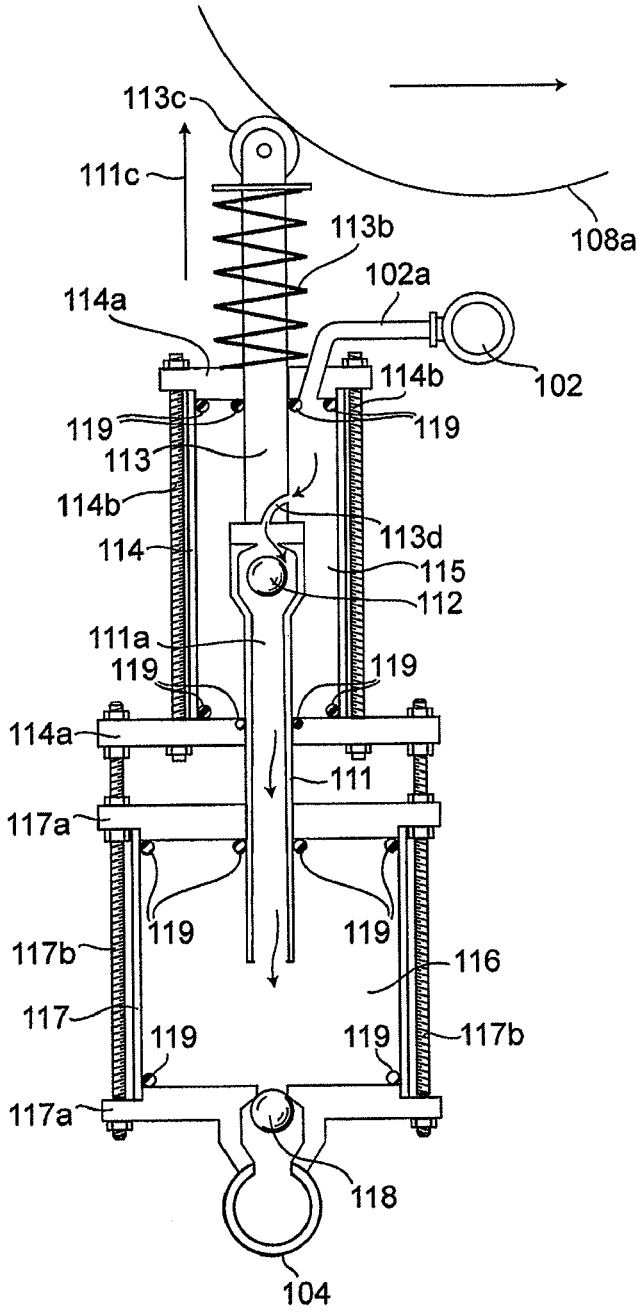
FIG. 3 is a schematic of a first embodiment of a piston assembly in a second state for use in the rotary pressure production device of FIG. 1.

Referring to FIGS. 2 and 3, an exemplary embodiment of a single piston assembly 110 of FIG. 1 is shown. Many variations of piston assemblies exist without departing from the concepts presented herein. The following paragraphs describe the various aspects and features of piston assembly 110.

In the embodiment shown in FIGS. 2-3, piston assembly 110 includes a hollow needle shaft 111 through which hydraulic fluid is forced from a low pressure volume 115 defined by housing 114 and end plates 114*a* to a high pressure volume 116 defined by housing 117 and end plates 117*a*. Additionally, end plates 114*a*, 117*a* are secured to housings 114, 117 by retaining rods 114*b*, 117*b*, respectively. As shown, housings 114, 117 are cylindrical in shape, however, housings 114, 117 could also be spherical, conical or virtually any other shape. Some shapes allow for maximization of the surface area of housings 114, 117 which advantageously increases the heat dissipation rate of the hydraulic fluid. Within an expanded portion 111*d* within the hollow portion 111*a* of shaft 111, a vacuum check valve 112 is disposed. Valve 112 is for enabling shaft 111 to act as a piston for forcing hydraulic fluid into the high pressure volume 116. Additionally, the expanded portion 111*d* of shaft 111 allows for lower flow resistance of the hydraulic fluid.

Piston assembly 110 also includes an actuator shaft 113 connected to the hollow needle shaft 111. Actuator shaft 113 is for moving hollow needle shaft 111 in a first direction 111*b* and a second, opposite direction 111*c*. FIG. 2 shows actuator shaft 113 and needle shaft 111 moving in the first direction while FIG. 3 shows actuator shaft 113 and needle shaft 111 moving in the second direction. Actuator shaft 113 can be configured in various ways to accomplish this function. In the exemplary embodiment shown in FIGS. 2-3, actuator shaft 113 includes a main stem portion 113*a*, a medium duty return spring 113*b*, a strike head 113*c* having a rotating wheel and an inlet port 113*d*. When the strike head 113*c* comes into contact with a cam lobe 108*a* of rotary actuator 108, the actuator shaft 113 and the hollow needle shaft 111 are moved in the first direction 111*b*. When cam lobe 108*a* is no longer in contact strike head 113*c*, the return spring 113*b* causes the actuator shaft 113 and the hollow needle shaft 111 to move in the second direction 111*c*. While the main stem 113*a* is moving in the second direction, hydraulic fluid flows from the low pressure volume 115 into the hollow portion 111*a* of the hollow needle shaft 111. Although only one inlet port 113*d* is shown for the purpose of clarity, a plurality of ports 113*d* is advantageous in reducing flow resistance of the hydraulic fluid into the hollow needle shaft 111.

Another aspect of piston assembly 110 is vacuum check valve 112. Vacuum check valve 112 is for simultaneously preventing hydraulic fluid from moving from the high pressure volume 116 to the low pressure volume 115 as the shaft 111 is moving in the first direction 111*b*. This operation allows for hollow needle shaft 111 to act as a piston to force hydraulic fluid within the shaft 111 into the high pressure volume, thereby increasing the pressure of the fluid in the high pressure volume. Multiple configurations exist for vacuum check valve 112 without departing from the concepts presented herein. In the embodiment shown in FIGS. 2-3 vacuum check valve 112 is a ball valve disposed within the hollow portion 111*a* of hollow needle shaft 111 and is biased to the closed position by a light duty return spring (not shown).

Yet another aspect of piston assembly 110 is discharge check valve 118. Discharge check valve 118 is for preventing hydraulic fluid in the high pressure volume 116 from entering the high pressure header 104 unless the pressure in volume 116 is higher than the pressure in header 104. This operation allows for the fluid pressure in the header 104 to be maintained at a desired minimum level regardless of the operational state of the piston assembly 110. Multiple configurations exist for discharge check valve 118 without departing from the concepts presented herein. In the embodiment shown in FIGS. 2-3 discharge check valve 118 is a ball valve disposed within an opening 117*a* of housing 117 and is biased to the closed position by a light duty return spring (not shown).

To prevent leakage in piston assembly 110, a variety of seals 119 are located throughout the assembly. Seals 119 can be of any type suitable for use in high pressure hydraulic fluid applications.

In operation, hollow needle shaft 111 increasingly occupies the high pressure volume 116 of housing 117 as shaft 111 moves in the first direction as the cam lobe 108*a* forces the shaft 111 in this direction. As this occurs, pressure within the housing 117 continually increases, as the hollow portion 111*a* of shaft 111 is full of hydraulic fluid and vacuum check valve 112 is in the closed position. As stated previously, pressure within the housing 117 increases until the pressure becomes greater than the fluid pressure within the header 104. At this point, discharge check valve 118 opens to allow hydraulic fluid to be moved into the header 104. Once contact with cam lobe 108*a* is removed, hollow needle shaft 111 starts moving in the second direction by operation of the return spring 113*b*, discharge check valve 104 closes and vacuum check valve 112 opens, thereby allowing pumped hydraulic fluid to quickly enter the hollow portion 111*a* of the shaft 111 via header 102, line 102*a*, low pressure volume 115 and inlet ports 113*d* in stem 113. Once, shaft 111 reaches its full extension in the second direction, it remains available to be moved in the first direction again by cam lobe 108*a*.

It should be noted that the diameter of hollow needle shaft 111 is considerably smaller than the corresponding diameter of the housing 117 into which hydraulic fluid is further pressurized. This arrangement has specific benefits in that a relatively small force is required to move the reduced diameter shaft 111 in the first direction, as compared to an arrangement where the shaft diameter is increased to match that of the housing. By pumping a relatively small volume of fluid with each stroke of shaft 111, the actuating force is decreased thereby allowing for the oscillating speed of the shaft 111 to be greatly increased. This allows for the plurality of piston assemblies 110 to easily deliver a steady stream of hydraulic fluid pressurized at 4,000 pounds per square inch (psi) and potentially beyond 50,000 psi. Additional, though smaller, advantages of utilizing such an arrangement is increased heat dissipation by the larger housing walls and reduced turbulence in the high pressure volume, both of which can potentially increase the overall efficiency of the system. One example of a suitable arrangement is a shaft 111 having an outside diameter of ⅛ inch and a housing 117 having an internal diameter of 1¼ inch with a wall thickness of about ¾ inch. In such an arrangement, the force required to move the shaft 111 in the first direction can be as low as 10 pounds, depending upon the desired fluid pressure. In comparison, a piston having a surface area of one square inch would require 4,000 pounds of force to generate the same fluid pressure. Thus, the use of the ⅛ inch hollow needle shaft can produce the same pressure as a 1 inch shaft, but at a piston force of 100 times less. A similar mechanical advantage can also be obtained by increasing the size of the housing 117 relative to the shaft 111.

It should also be noted that the plurality of piston assemblies shown in FIG. 1 can have varying diameters for shaft 111. Additionally, rotary actuator 108 can also be configured to selectively engage piston assemblies 110 having a particular shaft 111 diameter. In such a configuration, the rotary pressure production device 100 can engage only the piston assemblies 110 having larger shaft diameters to quickly build up a high volume of pressurized hydraulic fluid. This mode of operation is preferable during start up or regeneration when initial hydraulic fluid pressure is relatively low. As the hydraulic fluid pressure increases, the rotary pressure production device 100 can engage piston assemblies 110 having smaller shaft diameters in order to elevate the hydraulic fluid pressure further to a desired value.

Referring back to FIG. 1, another aspect of the overall system is high pressure fluid storage system 200. High pressure fluid storage system 200 is for storing pressurized hydraulic fluid produced by the rotary pressure production device 100 such that the fluid can be used independently of the operation of the rotary pressure production device 100. Various configurations exist for high pressure fluid storage system 200 without departing from the concepts herein. The following paragraphs describe various aspects and features of high pressure fluid storage system 200 which is piped into the larger system via lines 200A and 200B.

Figure 4A:
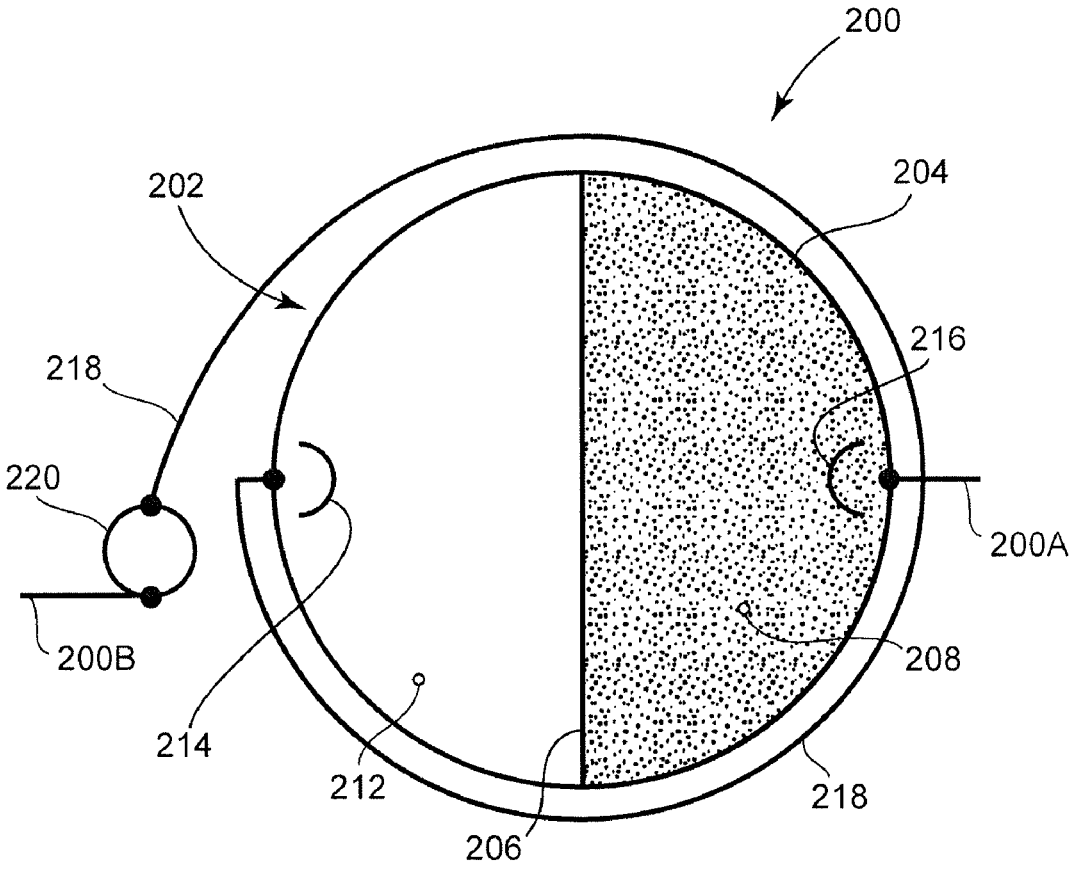
FIG. 4A is a schematic of a first embodiment of the high pressure fluid storage system of FIG. 1 in a first state.
Figure 4B:
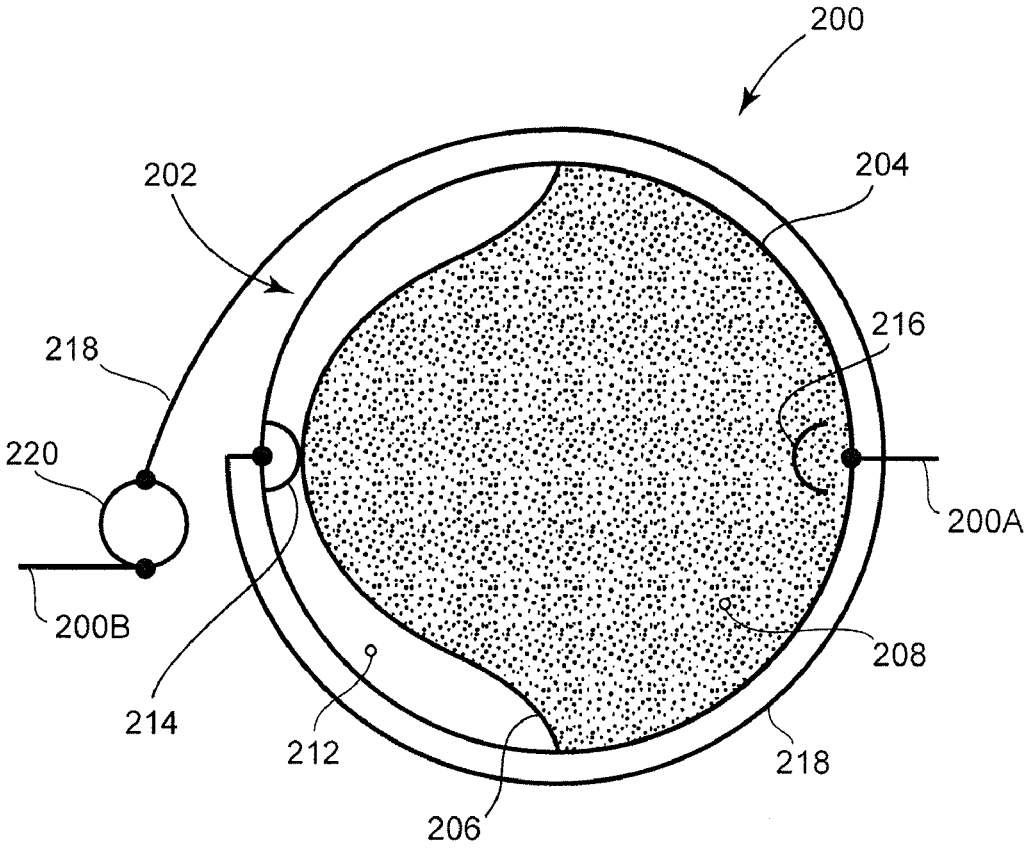
FIG. 4B is a schematic of the high pressure fluid storage system of FIG. 4*a* in a second state.
Figure 4C:
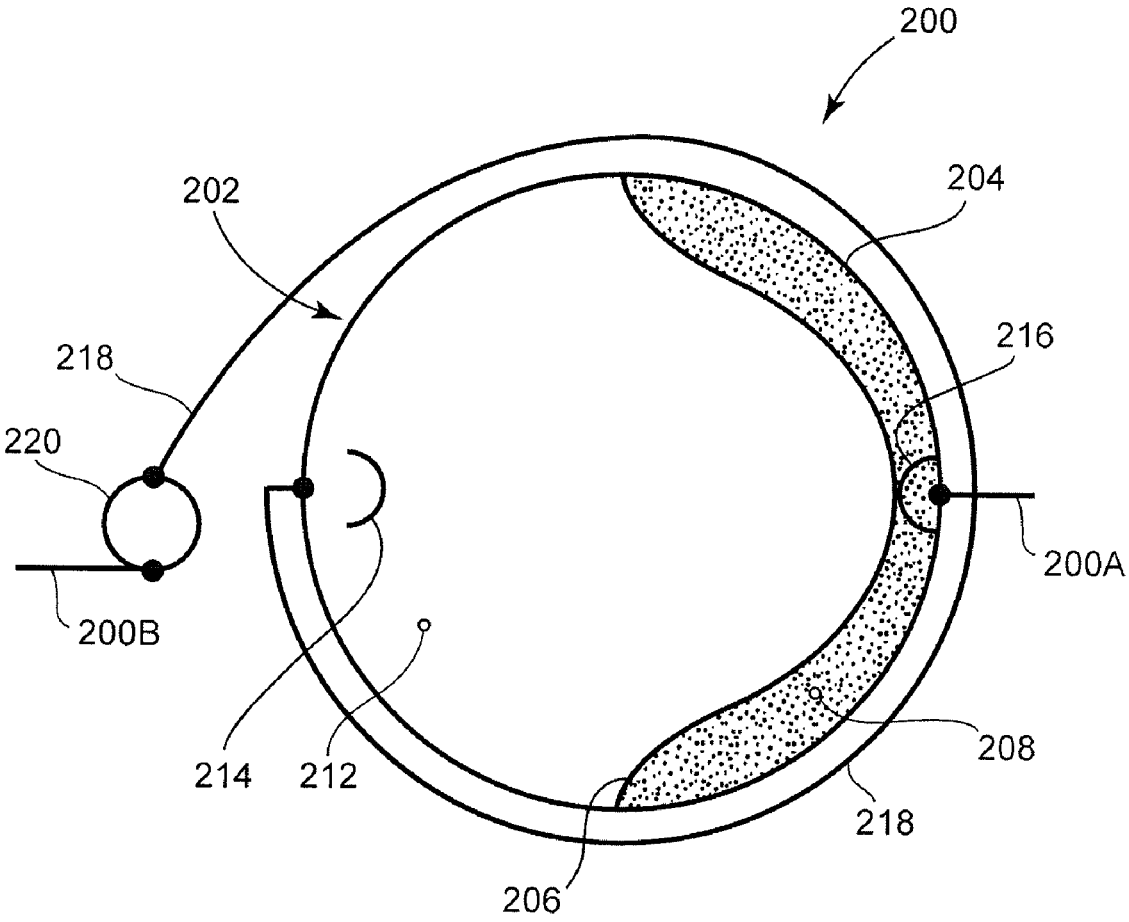
FIG. 4C is a schematic of the high pressure fluid storage system of FIG. 4*a* in a third state.

In a first embodiment shown at FIGS. 4A, 4B, 4C, fluid storage system 200 includes an aspirated accumulator 202 and a gas concentrator 220. As shown, accumulator 202 has a spherical shell 204 with a diaphragm wall 206 that divides the accumulator 202 into a hydraulic fluid volume 208 and a gas volume 212. Although a spherical shape for shell 204 is shown for its inherent burst resistance and minimal space occupancy, many other shapes for accumulator 202 are possible. The gas volume 212 is in fluid communication with concentrator 220 via conduit 218 which wraps about shell 204 multiple times to increase the volume of stored gas and to increase the burst resistance of the accumulator shell 204. Although only one winding revolution is shown on the drawings for the purpose of clarity, multiple revolutions about shell 204 are contemplated. The concentrator 220, which is shown as a hollow spherical shell, is in fluid communication with gas compressor 134. The hydraulic fluid volume 208 is in fluid communication with the rotary pressure production device 100, the hydraulic motors 132*a*, 134*a*, 136*a*, and the pressure reducing valve 124.

In operation, gas compressor 134 is activated to pre-pressurize the gas volume 212 of the accumulator 202 via lines 200B and 218. This pre-pressurization ensures that any hydraulic fluid stored within the accumulator 202 will be held at or above the minimum operating pressure for each of the hydraulic motors 132*a*, 134*a*, 136*a*. In some applications, the gas volume 212 will be pre-pressurized to 2,000 psi. FIG. 4C shows the accumulator 202 in a fully pre-pressurized state with a minimum volume of hydraulic fluid. To prevent a possible rupture in the diaphragm, normally open check valve 216 is provided which closes upon contact with the diaphragm 206. As pressurized hydraulic fluid pressure increases in the system via line 200A, check valve 216 is forced open and the diaphragm 206 is increasingly moved such that the hydraulic fluid volume 208 increases and the gas volume 212 decreases. FIG. 4A shows the diaphragm 206 in a neutral position wherein the gas volume 212 and the hydraulic fluid volume 208 have an equal volume. FIG. 4B shows accumulator 202 in a maximum hydraulic fluid storage state wherein a possible rupture in the diaphragm is prevented by the operation of normally open check valve 214 which closes flow from conduit 218 upon contact with the diaphragm 206.

It should be noted that, without concentrator 220 and conduit winding 218, any incremental increase in pressure arising from additional hydraulic fluid entering the hydraulic fluid volume 208 would cause a corresponding, equal rise in pressure in the gas in the gas volume 212. Additionally, with the volume decreasing by half in the gas volume 212, the pressure in the hydraulic fluid volume 208 will double. This circumstance can result in very rapid pressure swings in accumulator 202 which is undesirable. By adding additional gas volume to the gas volume 212, these pressure swings can be reduced and the average pressure in the hydraulic fluid volume 208 can be stabilized. This is accomplished through conduit winding 218 and concentrator 220. Further, concentrator 220 also aids in stabilizing pressure within conduit winding 218 which can be susceptible to rapid pressure loss without an additional volume of gas to draw upon. As a result, the disclosed system can be configured to, for example, ensure that the hydraulic fluid pressure in accumulator 202 is held between 2,000 psi and 4,000 psi while significantly more than doubling the initial minimum amount of hydraulic fluid stored in the hydraulic fluid volume 208.

Figure 5A:
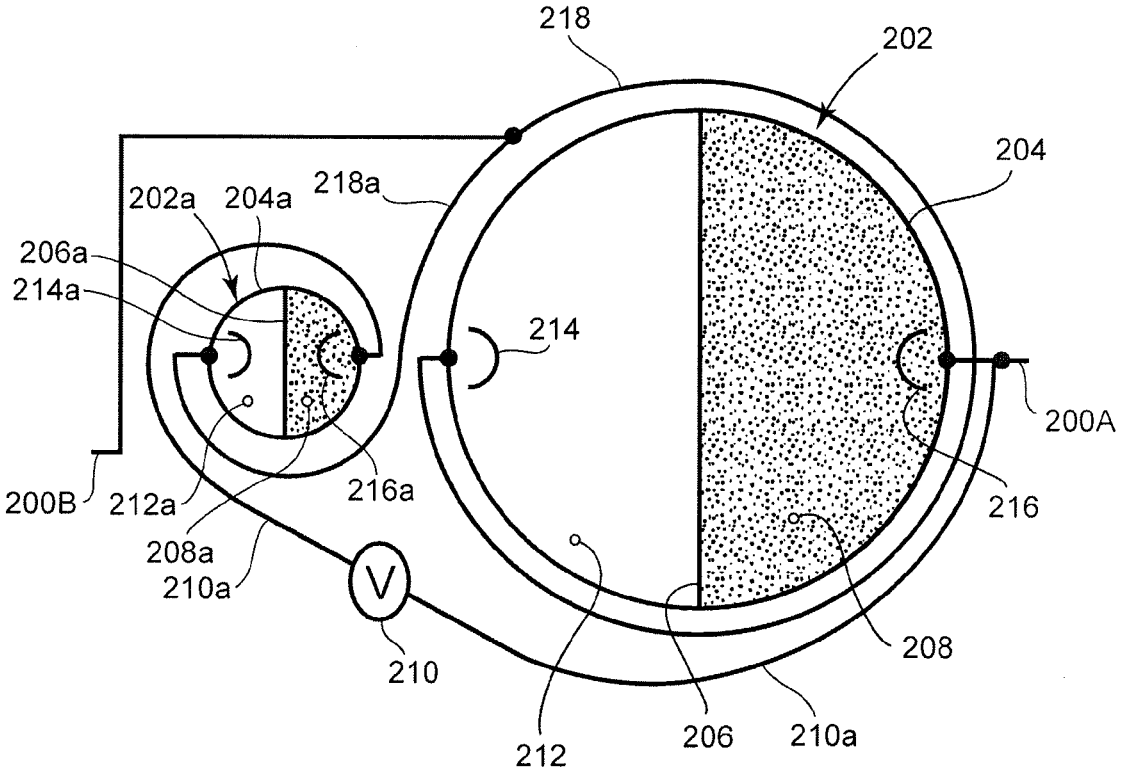
FIG. 5A is a schematic of a second embodiment of the high pressure fluid storage system of FIG. 1 in a first state.
Figure 5B:
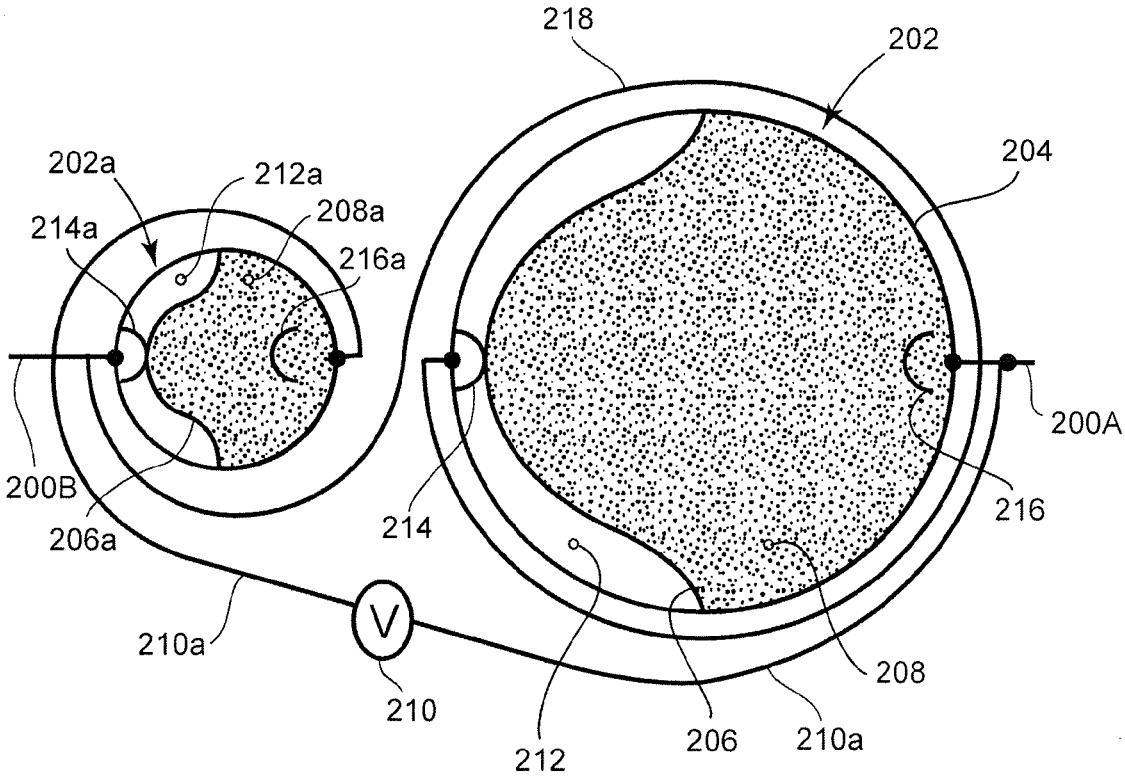
FIG. 5B is a schematic of the high pressure fluid storage system of FIG. 5*a* in a second state.
Figure 5C:
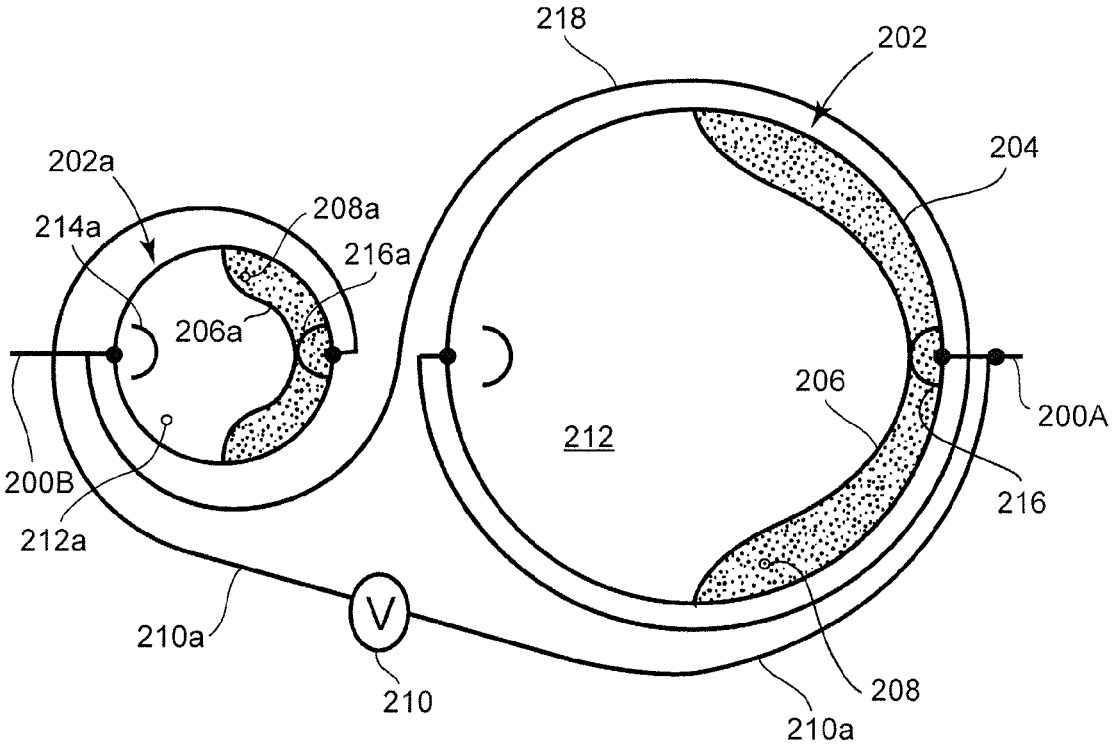
FIG. 5C is a schematic of the high pressure fluid storage system of FIG. 5*a* in a third state.

A second embodiment of a high pressure fluid storage system 200 is shown in FIGS. 5A-5C. This embodiment shares many of the same features as that described for the embodiment shown in FIGS. 4A-4C. Therefore, the above description for the embodiment of FIGS. 4A-4C is incorporated in its entirety for the embodiment of FIGS. 5A-5C. The primary difference for the embodiment of FIGS. 5A-5C is that two accumulators 202, 202*a* are utilized instead of the single accumulator 202 and the concentrator 220 of FIGS. 4A-4C. In this embodiment, both accumulators 202, 202*a* are piped in parallel to lines 200A and 200B and function simultaneously in the same way as described for accumulator 202 in FIGS. 4A-4C. However, accumulator 202*a* has a valve 210 that can be used to isolate accumulator 202*a* from the system, if desired. Additionally, although accumulator 202*a* is depicted as being smaller than accumulator 202*a*, the relative size of the accumulators can be adjusted to optimize the operation of the high pressure fluid storage system 200 in a variety of different applications.

For the accumulators 202, 202*a*, the diaphragm 206 may be oriented in various physical arrangements. The orientation shown in FIGS. 4A-5C is schematic and is not intended to represent any particular physical arrangement. One orientation that can be advantageous is to orient the accumulator(s) 202, 202*a* such that diaphragm 206 is horizontal and the hydraulic fluid volume 208 is above the gas volume 212. Over time, hydraulic fluid can saturate some membrane materials for diaphragm 206 and permeate into the gas volume 212. By placing the hydraulic fluid volume 208 above the gas volume 212, any permeated hydraulic fluid will collect at the bottom of the gas volume 212 of housing 202 where it can be easily drained away via check valve 214 or any other suitable device. Alternatively, or in conjunction with the above arrangement, the membrane material for diaphragm 206 can be chemically treated to increase resistance to membrane saturation penetration.

Figure 6:
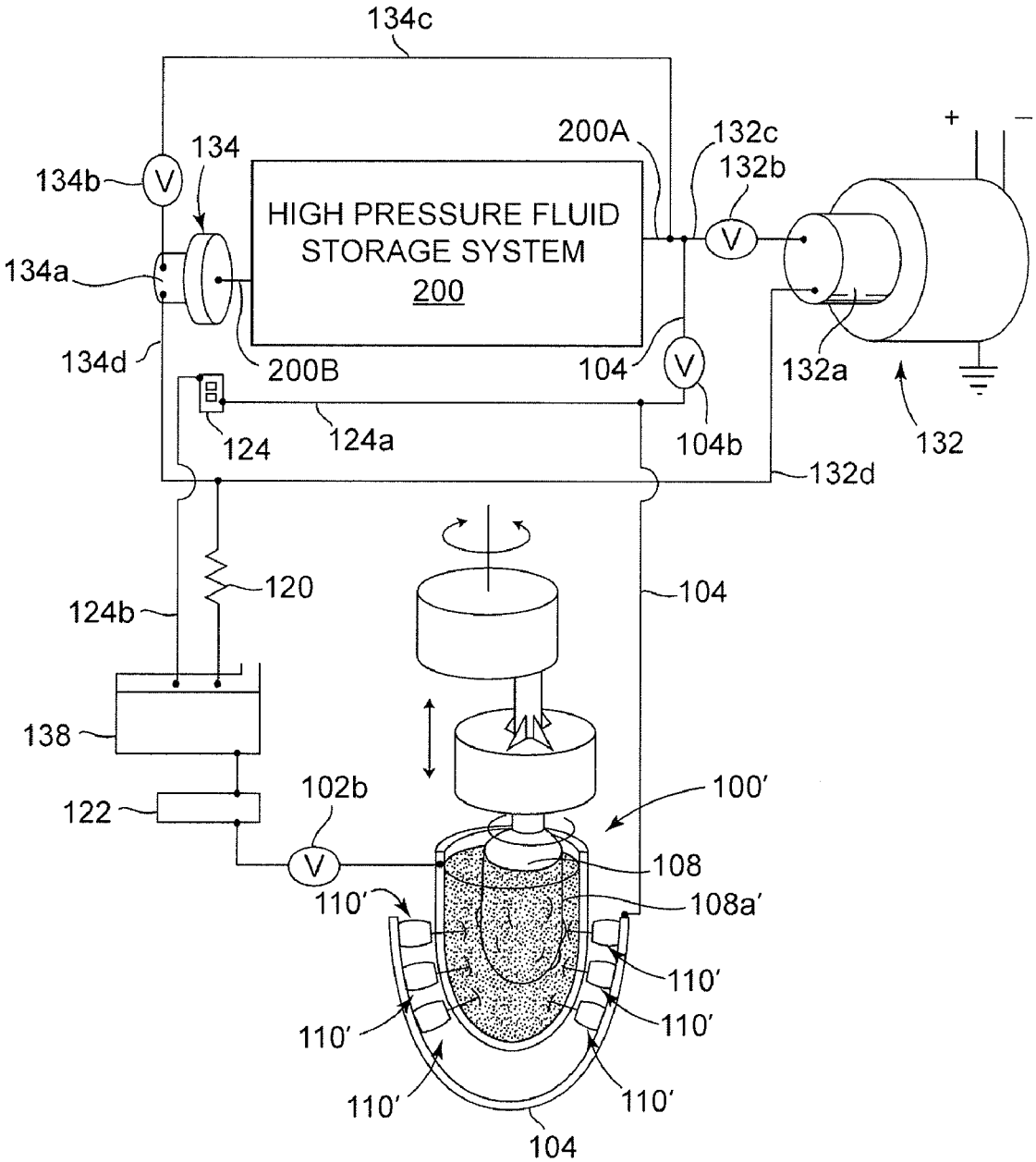
FIG. 6 is a schematic of a second embodiment of a system for producing, storing and utilizing pressurized hydraulic fluid, the system including a rotary pressure production device and a high pressure fluid storage system.
Figure 7:
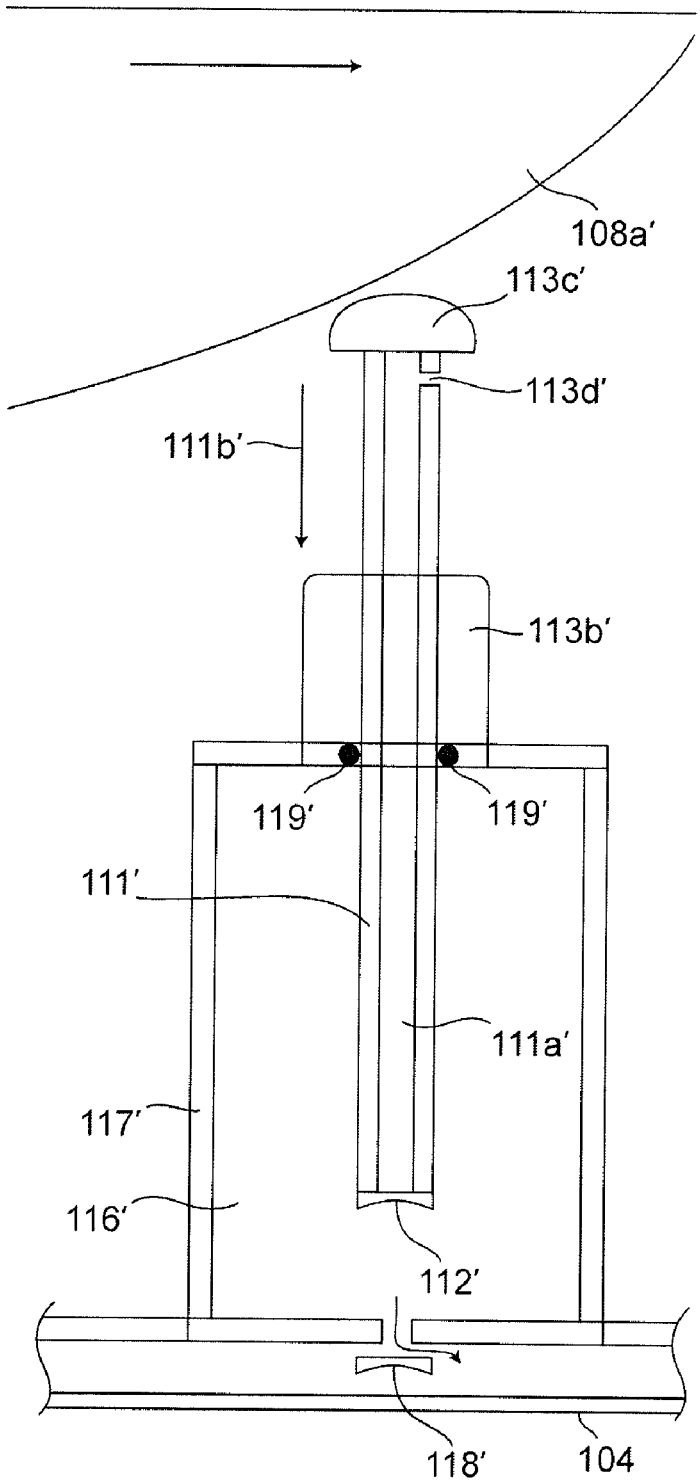
FIG. 7 is a schematic of a first embodiment of a piston assembly in a first state for use in the rotary pressure production device of FIG. 6.
Figure 8:
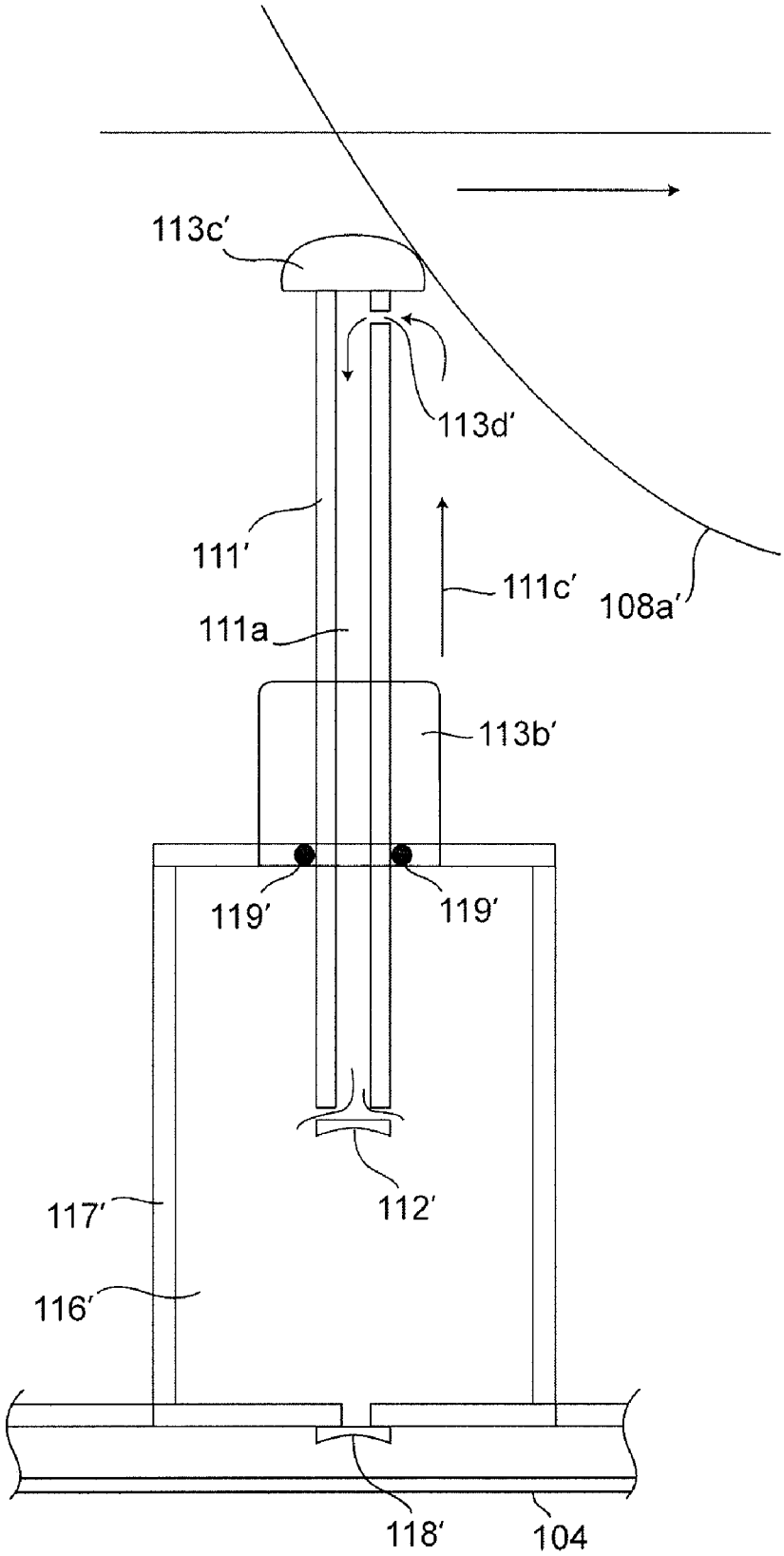
FIG. 8 is a schematic of a first embodiment of a piston assembly in a second state for use in the rotary pressure production device of FIG. 6.
Figure 9:
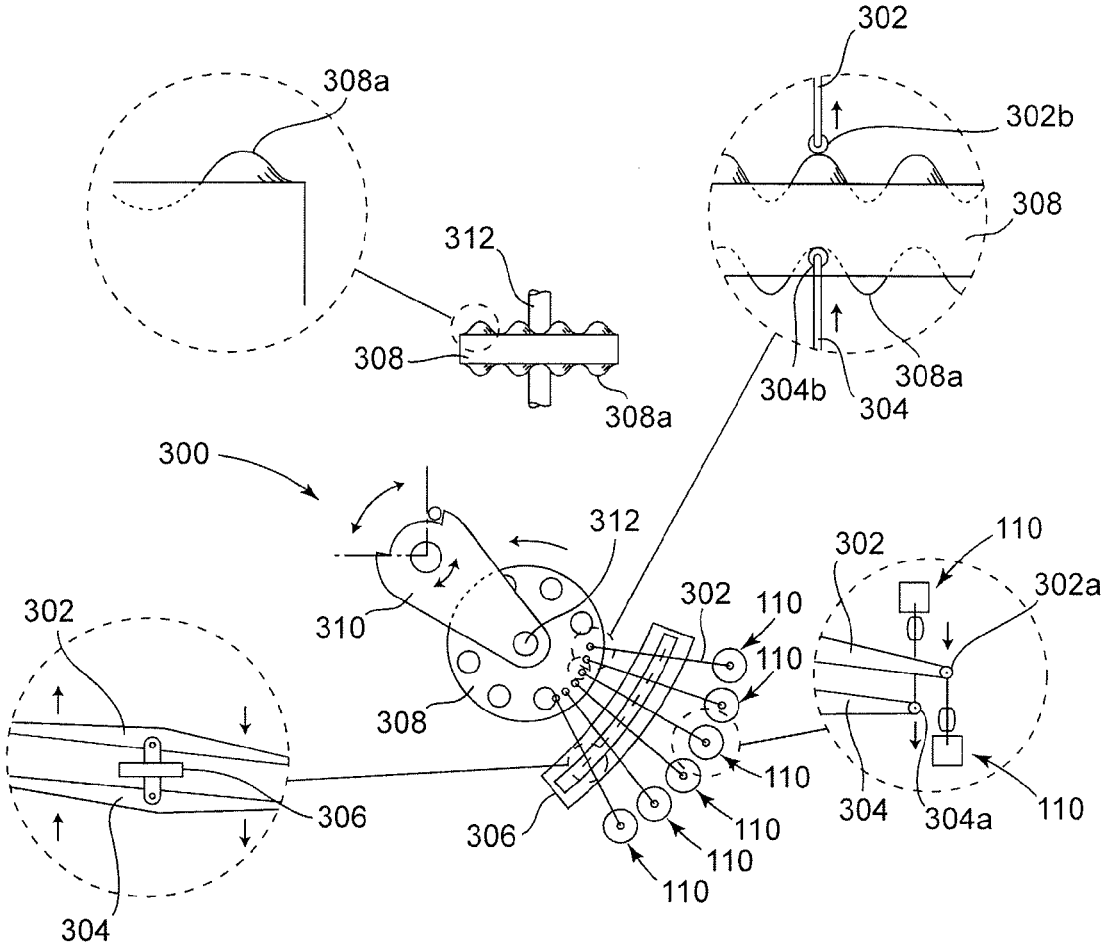
FIG. 9 is a schematic of a first embodiment of a rotary piston actuator assembly.

FIGS. 6-8 represent an alternative system in which pressurized hydraulic fluid is produced, stored and utilized. This system shares many of the same features as that described for the embodiments shown in FIGS. 1-5C. Therefore, the above description for the embodiments of FIGS. 1-5C is incorporated in its entirety for the embodiment of FIGS. 6-8. The discussion of the embodiment shown in FIGS. 6-8 here is generally limited to the differences between the embodiment of FIGS. 6-8 and FIGS. 1-3. The primary difference being the configuration of the rotary pressure production device 200 and the piston assemblies. Instead of having a low pressure header and feed pump, the system of FIGS. 6-8 relies upon atmospheric pressure to draw hydraulic fluid into the hollow needle shaft 111' from an atmospheric reservoir 102' within which rotary actuator 108' is disposed. The hydraulic fluid can be maintained within reservoir 102' by a flexible boot (not shown). Because of this atmospheric configuration, the piston assemblies 110' are also configured differently in a few aspects. First, hollow needle shaft 111' penetrates into the reservoir 102' and is directly connected to strike head 113*c*' thereby eliminating the need for stem 113 and housing 114. This configuration allows for inlet port 113*d*' to be installed directly into the shaft 111'. As stated previously, more than one inlet port 113*d*' is advantageous for decreased flow resistance. Another difference is in the specific construction of vacuum check valve 112' and discharge check valve 118'. Vacuum check valve 112' is located at the discharge end of shaft 111' and is a reed type valve rather than a ball valve. Discharge check valve 118' is also a reed type valve as well. As stated previously, many types of valves are possible for use in this application without departing from the concepts presented herein. Yet another difference is strike head 113*c*' which is shown as being stationary in comparison to the rotating wheel configuration of strike head 113*c*. It should be noted that any of the embodiments of the high pressure fluid storage system 200 are equally applicable for the system depicted in FIGS. 6-7 as they are for that depicted in FIGS. 1-3.

Referring to FIG. 8, an alternative system for actuating piston assembly 110 is shown that is particularly useful for regenerative braking applications in a vehicle drive train. Rather than causing the needle hollow shaft 111 to move through the use of cam lobes 108*a* and return spring 113*b*, the mechanism of FIG. 8 utilizes a rocker arm assembly 300. Rocker arm assembly 300 is for moving the hollow needle shafts 111 of the piston assemblies 110, via solid stem 113 in both the first direction 111*b* and the second direction 111*c* through the use of coupled rocker arms 302, 304. Rocker arm 302 is coupled at one end 302*a* to a piston assembly 110 while rocker arm 304 is coupled at one end 304*a* to an oppositely arranged piston assembly 110. Thus, when the end 302*a*, 304*a* of the rocker arms 302, 304 move, one piston assembly 110 is moved in the first direction 111*b* while the other is moved in the second direction 111*c*. Thus, as long as rocker arms 302, 304 are moving, at least one piston assembly 110 is producing pressurized hydraulic fluid at any given moment. Rocker arms 302, 304 are also coupled together by a crossbar 306 and arranged such that they can be actuated by a rotary actuator 308. Rotary actuator 308 has undulating lobes 308*a* which cause a second end 302*b*, 304*b* of the rocker arms 302, 304 to be displaced which causes an opposite displacement at ends 302*a*, 304*a*. Rotary actuator is mounted to drive assembly 310 via shaft 312 and may be driven by a motor or by the drive train of a vehicle in a regenerative braking application through the use of gears, a belt drive, a chain drive, or any other drive method known in the art. As shown, a plurality of rocker arms 302, 304 and piston assemblies 110 can be combined to produce a cumulative volume of pressurized hydraulic fluid.

The above are example principles. Many embodiments can be made. Additionally, as the figures of this application are all schematic in nature, many fittings, valves and other accessories that are required for an actual physical system are not shown. However, one having skill in the art will readily appreciate and understand that such components would be included in a fully constructed embodiment.

I claim:

1. A pressure production system for pressurizing a hydraulic fluid, the system comprising a rotary pressure production device comprising:

(a) a plurality of piston assemblies, each comprising:

i. a hollow needle piston shaft through which hydraulic fluid is moved from a low pressure volume to a high pressure volume as the piston shaft moves in a first direction;

ii. a high pressure header in fluid communication with the high pressure volume;

iii. a vacuum check valve in fluid communication with the low and high pressure volumes, the vacuum check valve being closed as the hollow needle piston shaft moves in the first direction and open as the hollow needle piston shaft moves in a second, opposite direction;

(b) a rotary actuator constructed and arranged to move each hollow needle piston shaft in the first direction;

(c) a discharge check valve in fluid communication with the high pressure volume and the high pressure header, the discharge check valve being open when the hollow needle piston shaft is moving in the first direction, and when fluid pressure in the high pressure volume exceeds fluid pressure in the high pressure header, the discharge check valve being closed when the hollow needle piston shaft is moving in the second direction;

(d) a first aspirated accumulator including:

i. a spherical shell;

ii. a diaphragm operably positioned within the spherical shell defining a gas volume and a hydraulic fluid volume, the hydraulic fluid volume being in fluid communication with the high pressure header;

iii. a compressed gas within the gas volume;

iv. a compressed gas conduit winding in fluid communication with the gas volume, the gas conduit winding being wound about the spherical shell;

v. a gas compressor to deliver compressed gas to the gas volume via the gas conduit winding.

2. The pressure production system of claim 1, further comprising a concentrator in fluid communication with the gas volume.

3. The pressure production system of claim 1, further comprising at least one check valve to prevent the diaphragm from rupturing.

4. The pressure production system of claim 3, wherein one check valve is operably positioned within the hydraulic fluid volume and one check valve is operably positioned within the gas volume.

5. The pressure production system of claim 1, further comprising a second aspirated accumulator piped in parallel arrangement with the first aspirated accumulator, the second aspirated accumulator including:

(a) a spherical shell;

(b) a diaphragm operably positioned within the spherical shell defining a gas volume and a hydraulic fluid volume, the hydraulic fluid volume being in fluid communication with the high pressure header;

(c) a compressed gas within the gas volume;

(d) a compressed gas conduit winding in fluid communication with the gas volume, the gas conduit winding being wound about the spherical shell; and (e) a gas compressor to deliver compressed gas to the gas volume via the gas conduit winding.

6. The pressure production system of claim 5, further comprising at least one check valve to prevent the diaphragms of the first and second aspirated accumulators from rupturing.

7. The pressure production system of claim 5, wherein one check valve is operably positioned within the hydraulic fluid volume and one check valve is operably positioned within the gas volume of the first and second aspirated accumulators.

8. The pressure production system of claim 1 wherein fluid pressure in the first accumulator is maintained at no less than 2,000 psi.

9. The pressure production system of claim 5 wherein fluid pressure in the first and second accumulators is maintained at no less than 2,000 psi.

10. The pressure production system of claim 1, further comprising an electric generator configured and arranged to be driven by the hydraulic fluid stored in the first aspirated accumulator.

11. The pressure production system of claim 5, further comprising an electric generator configured and arranged to be driven by the hydraulic fluid stored in the first and second aspirated accumulator.

12. The pressure production system of claim 1, wherein the rotary actuator is driven by an internal combustion engine.

13. The pressure production system of claim 5, wherein the rotary actuator is driven by an internal combustion engine.

14. The pressure production system of claim 1, wherein the rotary actuator is driven by a vehicle drive train in a regenerative braking application.

15. The pressure production system of claim 5, wherein the rotary actuator is driven by a vehicle drive train in a regenerative braking application.

16. A method for pressurizing hydraulic fluid, the method comprising the steps of:

(a) drawing hydraulic fluid from a low pressure volume into a hollow needle piston shaft;

(b) using a rotary actuator to move moving the hollow needle piston shaft and the hydraulic fluid within the hollow needle piston shaft in a first direction and into a high pressure volume;

(c) closing fluid communication between the high pressure volume and the low pressure volume;

(d) compressing the hydraulic fluid in the high pressure volume with the hydraulic fluid in the hollow needle piston such that the fluid is moved into a common high pressure header, the high pressure header being in fluid communication with the high pressure volume and with a hydraulic fluid volume of an aspirated accumulator, the aspirated accumulator having a spherical shell, the spherical shell containing a gas volume separated from the hydraulic fluid volume by a diaphragm, the gas volume receiving compressed gas from a compressed gas conduit winding, the compressed gas conduit winding being wound around the spherical shell;

(e) moving the hollow needle piston shaft in a second direction opposite the first direction; and (f) closing fluid communication between the high pressure volume and the high pressure header.

17. The method for pressurizing hydraulic fluid of claim 16, wherein the steps are repeated continuously.

18. The method for pressurizing hydraulic fluid of claim 16, wherein a plurality of hollow needle piston shafts repeat the steps of claim 18 continuously.

19. The method of pressurizing hydraulic fluid of claim 18, wherein some of the hollow needle piston shafts compress the hydraulic fluid at different times than other hollow needle piston shafts.

* * * * *